US009097105B2

(12) United States Patent
Holderman et al.

(10) Patent No.: US 9,097,105 B2
(45) Date of Patent: Aug. 4, 2015

(54) SWELLABLE SCREEN ASSEMBLY

(71) Applicant: Halliburton Energy Services, Inc., Houston, TX (US)

(72) Inventors: Luke W. Holderman, Plano, TX (US); Alf Kolbjorn Sevre, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 500 days.

(21) Appl. No.: 13/644,085

(22) Filed: Oct. 3, 2012

(65) Prior Publication Data

US 2013/0036591 A1 Feb. 14, 2013

Related U.S. Application Data

(62) Division of application No. 12/539,754, filed on Aug. 12, 2009, now Pat. No. 8,302,680.

(51) Int. Cl.
*B23P 11/00* (2006.01)
*E21B 43/08* (2006.01)
(Continued)

(52) U.S. Cl.
CPC ..... *E21B 43/08* (2013.01); *E21B 17/026* (2013.01); *E21B 43/103* (2013.01); *Y10T 29/49826* (2015.01)

(58) Field of Classification Search
CPC ..... E21B 43/08; E21B 43/103; E21B 17/026; Y10T 29/49826
USPC ..... 29/428, 896.6; 166/56, 157, 227, 228, 166/229, 230, 231, 232, 234, 235, 236, 276, 166/369
See application file for complete search history.

(56) References Cited

U.S. PATENT DOCUMENTS 6,173,788 B1 1/2001 Lembcke
6,543,545 B1 4/2003 Chatterji et al.
(Continued)

FOREIGN PATENT DOCUMENTS

GB 2421527 1/2006
WO 9626350 8/1996
(Continued)

OTHER PUBLICATIONS

Chinese Patent Application No. 201010253346.4, "Office Action", mailed Feb. 22, 2013, 15 pages.
(Continued)

*Primary Examiner* — David Bryant
*Assistant Examiner* — Steven A Maynard
(74) *Attorney, Agent, or Firm* — Kilpatrick Townsend & Stockton LLP

(57) ABSTRACT

Screen assemblies capable of being disposed in a wellbore for hydrocarbon fluid production are described. The screen assemblies can support tubes for receiving hydrocarbon fluid and reduce or eliminate plugging of the tubes by swellable material. A screen assembly may include a support material between a tube and swellable material located exterior to a base pipe. The tube may include perforations and can receive and direct hydrocarbon fluids from the formation. The swellable material can expand after contact with an activating fluid and can displace the tube toward a surface of the bore. The swellable material can expand more than the support material and the support material can reduce or prevent plugging of the perforations by the swellable material expanding.

7 Claims, 8 Drawing Sheets

(51) Int. Cl.
*E21B 17/02* (2006.01)
*E21B 43/10* (2006.01)

(56) References Cited

U.S. PATENT DOCUMENTS

| | | | | |
|---|---|---|---|---|
| 6,571,871 | B2 | 6/2003 | Lauritzen et al. | |
| 6,719,064 | B2 | 4/2004 | Price-Smith et al. | |
| 6,868,907 | B2 | 3/2005 | Homstvedt et al. | |
| 7,013,979 | B2 | 3/2006 | Richard | |
| 7,284,603 | B2 | 10/2007 | Ohmer | |
| 7,318,481 | B2 | 1/2008 | Richard | |
| 8,302,680 | B2 | 11/2012 | Holderman et al. | |
| 2004/0035590 | A1 | 2/2004 | Richard | |
| 2007/0056735 | A1* | 3/2007 | Bosma et al. | 166/295 |
| 2008/0041577 | A1 | 2/2008 | Baaijens et al. | |
| 2008/0283240 | A1 | 11/2008 | Baaijens et al. | |
| 2009/0008092 | A1 | 1/2009 | Haeberle et al. | |
| 2009/0084559 | A1 | 4/2009 | Freyer | |
| 2009/0173490 | A1 | 7/2009 | Dusterhoft et al. | |
| 2011/0036567 | A1 | 2/2011 | Holderman et al. | |
| 2011/0042096 | A1* | 2/2011 | Nutley et al. | 166/369 |

FOREIGN PATENT DOCUMENTS

| | | |
|---|---|---|
| WO | 2006003112 | 1/2006 |
| WO | 2008122809 | 11/2008 |
| WO | 2009001073 | 12/2008 |
| WO | 2010025152 | 3/2010 |

OTHER PUBLICATIONS

Chinese Patent Application No. 201010253346.4, "Office Action", mailed Dec. 31, 2013, 7 pages.
U.S. Appl. No. 12/201,468, filed Aug. 29, 2008.
U.S. Appl. No. 12/201,655, filed Aug. 29, 2008.
U.S. Appl. No. 12/201,776, filed Aug. 29, 2008.
U.S. Appl. No. 12/539,749, filed Aug. 12, 2009.
U.S. Appl. No. 12/539,754, Non-Final Office Action, mailed Jul. 25, 2011; 10 pages.
European Patent Application No. 10172484.7, Extended Search Report, mailed Aug. 4, 2011; 3 pages.
Australian Patent Application No. 2010206092, First Examination Report, mailed Sep. 14, 2011; 3 pages.
U.S. Appl. No. 12/539,754, Amendment Submitted on Oct. 17, 2011 in Response to Non-Final Office Action issued Jul. 25, 2011; 17 pages.
U.S. Appl. No. 12/539,754, Non-Final Office Action, mailed Dec. 13, 2011; 9 pages.
U.S. Appl. No. 12/539,754, Amendment Submitted on Feb. 13, 2012 in Response to Non-Final Office Action issued Dec. 13, 2011; 17 pages.
U.S. Appl. No. 12/539,754, Final Office Action, mailed Apr. 18, 2012; 11 pages.
U.S. Appl. No. 12/539,754, Amendment Submitted on May 25, 2012 in Response to Final Office Action issued Apr. 18, 2012; 11 pages.
U.S. Appl. No. 12/539,754, Advisory Action, mailed Jun. 6, 2012; 4 pages.
U.S. Appl. No. 12/539,754, Amendment and Request for Continued Examination Submitted on Jun. 20, 2012 in Response to Final Office Action issued Apr. 18, 2012; 16 pages.
U.S. Appl. No. 12/539,754, Notice of Allowance, mailed Aug. 14, 2012; 5 pages.

* cited by examiner

SWELLABLE SCREEN ASSEMBLY

This application is a divisional of U.S. patent application Ser. No. 12/539,754, filed Aug. 12, 2009, allowed, which is incorporated herein by reference in its entirety.

TECHNICAL FIELD OF THE INVENTION

The present invention relates generally to control screens for subterranean fluid production and, more particularly (although not necessarily exclusively), to a swellable screen assembly having support material for a tube.

BACKGROUND

Hydrocarbons can be produced through a wellbore traversing a subterranean formation. In some cases, the formation may be unconsolidated or loosely consolidated. Particulate materials, such as sand, from these types of formations may be produced together with the hydrocarbons. Production of particulate materials presents numerous problems. Examples of problems include particulate materials being produced at the surface, causing abrasive wear to components within a production assembly, partially or fully clogging a production interval, and causing damage to production assemblies by collapsing onto part or all of the production assemblies.

Expandable sand control screens can be used to provide stability to a formation to prevent or reduce collapses and filter particulate materials from hydrocarbon fluids. Expandable sand control screens can include a swellable material, such as a high-swelling rubber, and a filter device on the exterior of the swellable material. The swellable material can be located proximate the production interval and, when activated by a fluid, expand to displace the filter device to the wellbore. The filter device can include perforations through which hydrocarbon fluids from the formation can be received and directed into a production pipe. This type of expandable sand control screen can be effective in filtering and providing formation stability.

In some applications, however, the swellable material may expand into the perforations after contacting the activating fluid. Expanding into the perforations may result in the swellable material partially or completely plugging the perforations of the filter device. Plugged perforations can reduce or prevent hydrocarbon fluids from flowing to an internal flow path of the production pipe. A rework of the control screen assembly may be required to alleviate the plugging. Reworks cost substantial time and money because they require suspension of hydrocarbon production for a measurable amount of time and require duplication of work in locating the control screen assembly in the wellbore.

Therefore, screen assemblies that can provide radial support to formations and reduce or eliminate plugging are desirable. Methods of manufacturing screen assemblies that can reduce or eliminate plugging are also desirable.

SUMMARY

Certain embodiments of the present invention are directed to screen assemblies that can receive hydrocarbon fluids from a hydrocarbon-bearing subterranean formation and reduce or eliminate plugging. Reducing or eliminating plugging can reduce or eliminate need for a rework. The screen assemblies may include a tube and a support material exterior to swellable material. The tube can be configured to receive hydrocarbon fluids from the formation. The support material can prevent or reduce plugging of the tube by the swellable material when the swellable material expands. Certain screen assemblies can also provide stability to a subterranean formation.

In one aspect, a screen assembly capable of being disposed in a bore is provided. The screen assembly can include a swellable material, a tube, and a support material. The swellable material can be disposed exterior to a base pipe. The tube can be disposed exterior to the swellable material. The support material can be disposed between the swellable material and the tube. In response to contact with an activating fluid, the swellable material is capable of expanding and displacing at least part of the tube toward a surface of the bore. The swellable material can expand more than the support material in response to the activating fluid.

In one embodiment, the support material is a low-swelling rubber compound.

In one embodiment, the support material is a non-swelling rubber compound that can retain an initial shape when the swellable material expands.

In one embodiment, the swellable material includes a groove and the tube and the support material are disposed in the groove.

In one embodiment, the tube is a filtration tube that includes a filter media for filtering particulate materials from hydrocarbon fluids.

In one embodiment, the tube includes perforations. The support material can isolate at least part of the perforations from the swellable material.

In one embodiment, the support material is hydrogenated nitrile butadiene rubber (HNBR).

In one aspect, a screen assembly that can be disposed in a bore is provided. The screen assembly includes a swellable material, a tube, and a support material. The swellable material is disposed exterior to a base pipe. The tube includes perforations and is disposed exterior to the swellable material. The support material is disposed between the swellable material and the tube. The support material can isolate at least part of the perforations from the swellable material. In response to contact with an activating fluid, the swellable material can expand and displace at least part of the tube toward a surface of the bore.

In one aspect, a method of manufacturing a screen assembly capable of being disposed in a bore is provided. The method of manufacturing includes positioning a casting member exterior to a base pipe. Support material is positioned between the casting member and the base pipe. A swellable material is positioned between the support material and the base pipe. The swellable material can expand in response to an activating fluid. The swellable material is processed to form a groove in which the casting member and the support material are disposed. The casting member is removed from the groove. A tube is positioned in the groove.

In one embodiment, a framing member is positioned exterior to the base pipe. The casting member is positioned exterior to the base pipe by coupling the casting member to the framing member.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Certain aspects and embodiments of the present invention relate to screen assemblies capable of being disposed in a bore, such as a wellbore, of a subterranean formation for use in producing hydrocarbon fluids from the formation. The screen assemblies may be configured to support tubes and reduce or eliminate plugging of the tubes by swellable material. Screen assemblies according to some embodiments include a support material between a tube and swellable material located exterior to a base pipe. The tube can include perforations and can receive and direct hydrocarbon fluids from the formation. The swellable material can expand after contact with an activating fluid and can displace the tube toward a surface of the bore. The swellable material can expand more than the support material and the support material can reduce or prevent plugging of the perforations by the swellable material expanding. For example, the support material can isolate the perforations from the swellable material.

The support material may be any material that can retain an initial shape after contact with the activating fluid or otherwise expand a relatively low amount after contact with the activating fluid. Examples of support material can include a low swelling rubber compound, a non-swelling rubber compound, a polymer, and a metal. Examples of suitable metals from which support material may be made can include steel, iron, brass, copper, bronze, tungsten, titanium, cobalt, nickel, or a combination of these or other types of materials. An example of a rubber compound that may be suitable for support material includes hydrogenated nitrile butadiene rubber (HNBR).

Figure 1A:
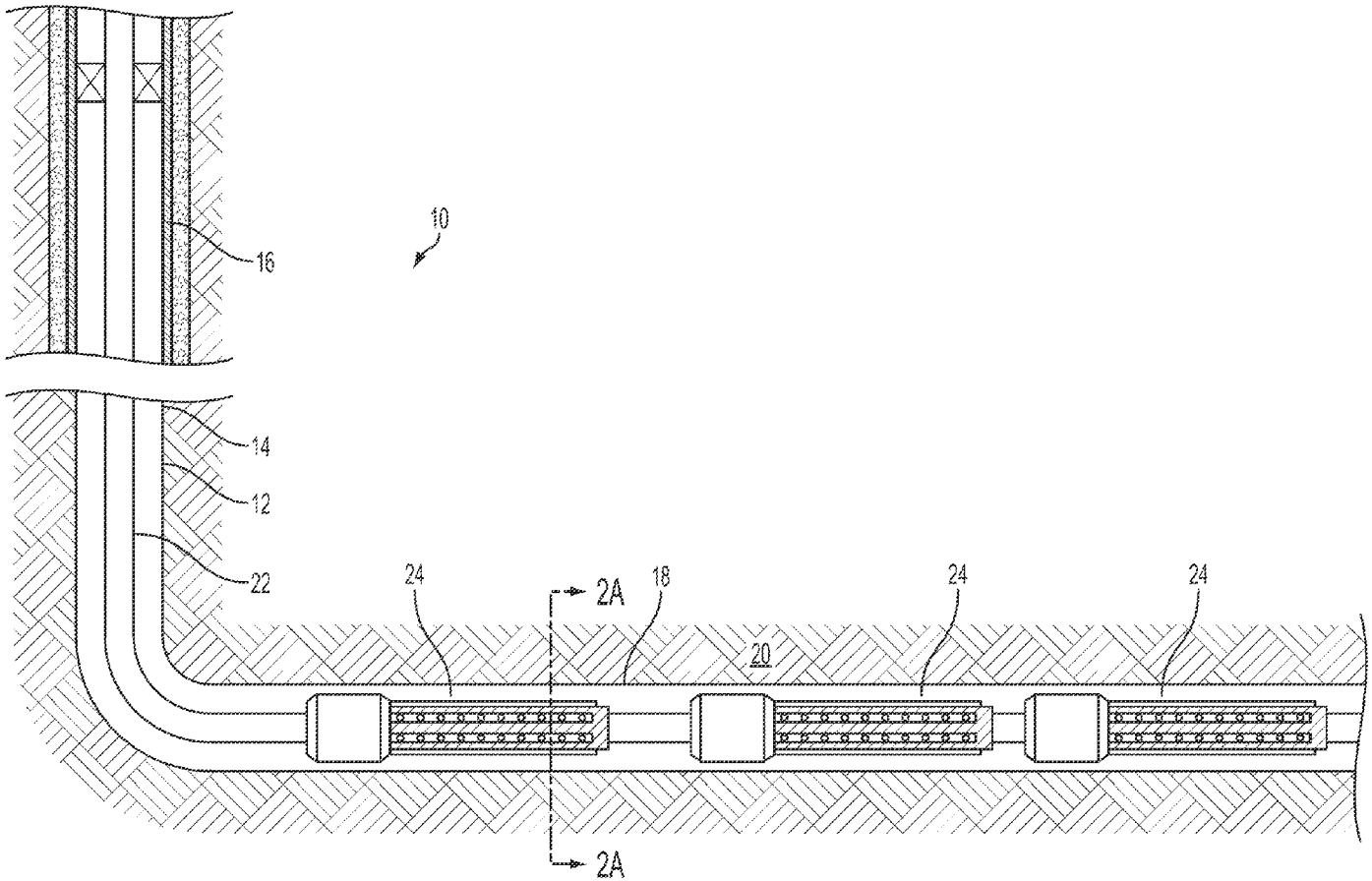
FIG. 1A is a schematic illustration of a well system having screen assemblies in a running configuration according to one embodiment of the present invention.

FIG. 1A shows a well system 10 with screen assemblies according to certain embodiments of the present invention. The well system 10 includes a bore that is a wellbore 12 extending through various earth strata. The wellbore 12 has a substantially vertical section 14 and a substantially horizontal section 18. The substantially vertical section 14 includes a casing string 16 cemented at an upper portion of the substantially vertical section 14. The substantially horizontal section 18 is open hole and extends through a hydrocarbon bearing subterranean formation 20.

A tubing string 22 extends from the surface within wellbore 12. The tubing string 22 can provide a conduit for formation fluids to travel from the substantially horizontal section 18 to the surface. Screen assemblies 24 are positioned with the tubing string 22 in the substantially horizontal section 18. The screen assemblies 24 are shown in a running or unextended configuration. In some embodiments, screen assemblies 24 are sand control screen assemblies that can receive hydrocarbon fluids from the formation, direct the hydrocarbon fluids for filtration or otherwise, and stabilize the formation 20.

Figure 1B:
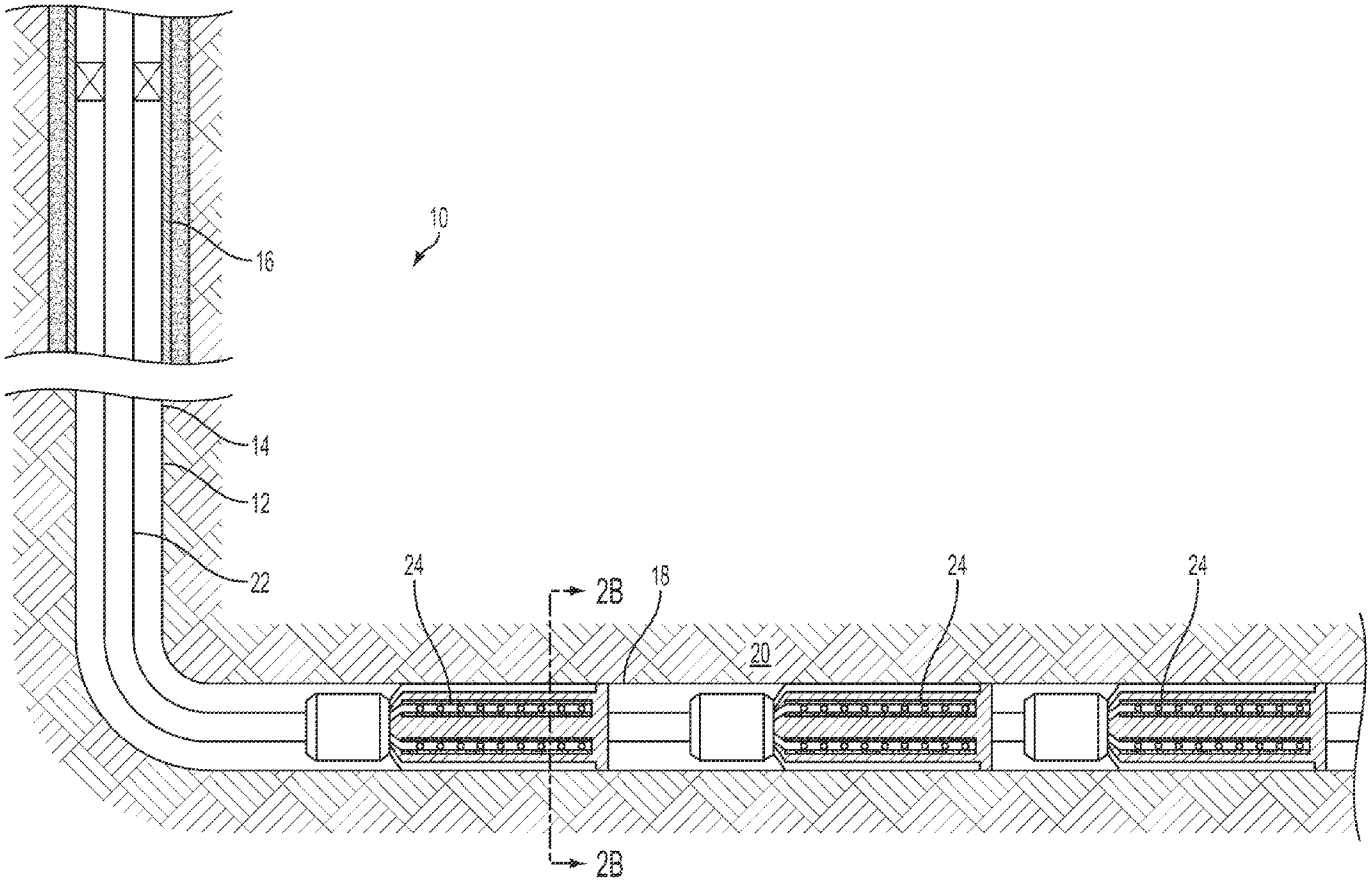
FIG. 1B is a schematic illustration of a well system having screen assemblies in an operating configuration according to one embodiment of the present invention.

FIG. 1B shows the well system 10 with screen assemblies 24 in an operating or a radially expanded configuration. Each of the screen assemblies 24 can include a base pipe, a swellable material, one or more tubes, and support material. The swellable material may be a relatively high swelling rubber compound or polymer and can be disposed exterior to at least part of the base pipe. The tubes may be located exterior to the swellable material. The tubes can include perforations for receiving hydrocarbon fluids from the formation. The tubes can direct the hydrocarbon fluids toward an internal flow path of the base pipe and can provide support to the formation. In some embodiments, the tubes are filtration tubes that can filter particulate materials from the hydrocarbon fluids. The support material can be located between the swellable material and the tubes and can reduce or prevent plugging by the swellable material in an operating configuration. For example, the support material can isolate one or more perforations from the swellable material. Some embodiments of the screen assemblies 24 also include an outer housing disposed exterior to part of the base pipe that can receive hydrocarbon fluids from tubes and direct the hydrocarbon fluids to the internal flow path of the base pipe.

When an activating fluid contacts the screen assemblies 24, the swellable material of each of the screen assemblies 24 can expand. Expansion of the swellable material can displace tubes of the screen assemblies 24 to contact a surface of wellbore 12. The activating fluid may be any fluid to which the swellable material responds by expanding. Examples of activating fluid include hydrocarbon fluids, water, and gasses.

FIGS. 1A and 1B show tubing string 22 with screen assemblies 24. Tubing strings according to various embodiments of the present invention, however, may include any number of other tools and systems in addition to screen assemblies 24. Examples of other tools and systems include fluid flow control devices, communication systems, and safety systems. Tubing string 22 may also be divided into intervals using zonal isolation devices such as packers. Zonal isolation devices may be made from materials that can expand upon contact with a fluid, such as hydrocarbon fluids, water, and gasses.

In addition, FIGS. 1A and 1B show screen assemblies 24 according to certain embodiments of the present invention in the substantially horizontal section 18 of the wellbore 12.

Screen assemblies according to various embodiments of the present invention, however, can be used in other types of wellbores, such as deviated, vertical, or multilateral wellbores. Deviated wellbores may include directions different than, or in addition to, a general horizontal or a general vertical direction. Multilateral wellbores can include a main wellbore and one or more branch wellbores. Directional descriptions are used herein to describe the illustrative embodiments but, like the illustrative embodiments, should not be used to limit the present invention.

Screen assemblies according to some embodiments of the present invention can be disposed in an injection well. In an injection well, water or other fluid is injected into the well to increase flow of hydrocarbon fluids to a nearby production well. One or more screen assemblies can be disposed in the injection well to provide support during and after the fluid injection process. In some embodiments, injected fluid exits a base pipe through openings in the base pipe and perforations in the tubes. Support material can reduce or prevent plugging of the perforations by swellable material in an operating configuration to permit injected fluids to exit the perforations.

In addition, screen assemblies according to some embodiments of the present invention can be disposed in a cased hole completion. In a cased hole completion, a large diameter pipe is positioned between a production string and a formation. The large diameter pipe may be a base pipe and swellable material can be disposed exterior to at least part of the large diameter pipe. One or more tubes can be located exterior to the swellable material and support material can be located between the swellable material and the tubes.

Figure 2A:
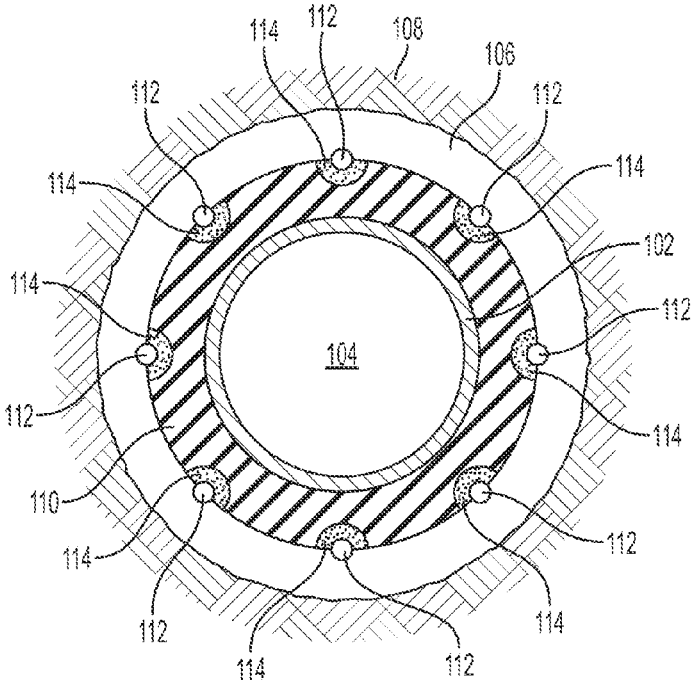
FIG. 2A is a cross sectional view along line 2A-2A of a screen assembly of FIG. 1A in a running configuration according to one embodiment of the present invention.
Figure 2B:
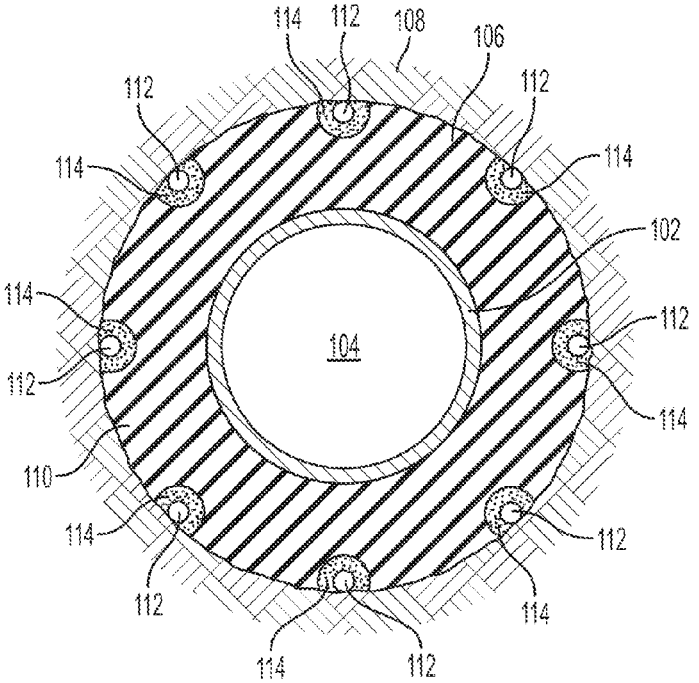
FIG. 2B is a cross sectional view along line 2B-2B of a screen assembly of FIG. 1B in a running configuration according to one embodiment of the present invention.

FIGS. 2A and 2B show cross-sectional views of part of a screen assembly 24 from FIGS. 1A (running configuration) and 1B (operating configuration), respectively. FIGS. 2A and 2B illustrate a base pipe 102 that defines an internal flow path 104 through which hydrocarbon fluids, for example, can flow. The base pipe 102 is disposed in a bore 106 in a formation 108. A swellable material 110 surrounds an exterior of the base pipe 102. The swellable material 110 may be coupled to the base pipe 102, such as by bonding or other suitable technique.

Tubes 112 are positioned on an exterior of the swellable material 110. FIG. 2A shows eight tubes 112, but screen assemblies according to various embodiments of the present invention can include any number, from one to many, of tubes 112. Each of the tubes 112 can include perforations that can receive hydrocarbon fluid from the formation 108 in an operating configuration and direct the hydrocarbon fluids to an internal flow path 104. For example, tubes 112 may direct hydrocarbon fluids to a housing in which the hydrocarbon fluids are filtered and provided to the internal flow path 104.

In some embodiments, tubes 112 are filtration tubes that can filter particulate materials from the hydrocarbon fluids and can direct the filtered hydrocarbon fluids to the internal flow path 104 through openings in the base pipe 102. The filtration tubes may each include a filter housing for filter material. The filter material can include a filtration opening through which hydrocarbon fluid can be directed to an opening in the base pipe 102. The filter housing may be made of any suitable material and may be partially perforated to allow hydrocarbon fluids to enter the filter housing. The filter material may be any suitable material, such as a fine mesh, that can filter particulate materials from hydrocarbon fluid.

Support material 114 is located between each of the tubes 112 and the swellable material 110. For example, the swellable material 110 may include one or more grooves. Support material 114 and one of the tubes 112 can be located in each groove. Support material 114 may be a relatively low swelling or a non-swelling material that can prevent or reduce swellable material 110 from plugging perforations in the tubes 112. The support material 114 can isolate perforations in the tubes 112 from the swellable material 110 when the swellable material 110 expands. Examples of support material 114 can include a low swelling rubber compound, a non-swelling rubber compound, a polymer, and a metal. Examples of a low swelling or a non-swelling rubber compound include HNBR. Examples of suitable metals from which support material 114 can be made can include steel, iron, brass, copper, bronze, tungsten, titanium, cobalt, nickel, or a combination of these or other types of materials. In some embodiments, the support material 114 is coupled to one or both of the swellable material 110 and tubes 112 through bonding or other suitable technique.

The swellable material 110 can expand after contacting an activating fluid and can displace the tubes 112 to contact the formation 108 at an internal diameter of a bore 106, as shown in FIG. 2B. Examples of activating fluid include hydrocarbon fluids, gasses, and water. The swellable material 110 can expand more than the support material 114, which may be configured to expand some after contacting an activating fluid or configured to expand none and retain its initial shape after contacting an activating fluid.

Various techniques can be used to contact the swellable material 110 with an activating fluid. One technique includes configuring the swellable material 110 to expand upon contact with activating fluids already present within the bore when the screen assembly is installed or with activating fluids produced by the formation 108 after installation. The swellable material 110 may include a mechanism for delaying swell to prevent swelling during installation. Examples of a mechanism for delaying swell include an absorption delaying layer, coating, membrane, or composition. Another technique includes circulating activating fluid through the well after the screen assembly is installed in the well. In other embodiments, swellable material 110 is capable of expansion upon its location in an environment having a temperature or a pressure that is above a pre-selected threshold in addition to or instead of an activating fluid.

Expansion of the swellable material 110 can displace the tubes 112 to contact the formation 108. The thickness of the swellable material 110 can be optimized based on the diameter of the screen assembly and the diameter of the bore 106 to maximize contact area of the tubes 112 and swellable material 110 with the formation 108 upon expansion. Part of the swellable material 110 can expand between the tubes 112 and contact the formation 108 between the tubes 112 to conform to non-uniform bore diameters, for example. The support material 114 can isolate tube perforations from the swellable material 110 and prevent the swellable material 110 from expanding to plug perforations or other openings in tubes 112.

The swelled screen assembly can reduce or eliminate annular flow of hydrocarbon and other fluids, provide multiple flow paths for hydrocarbon fluids and provide stabilization to the formation 108. For example, the swelled screen assembly can support the formation 108 to prevent formation collapse. In some embodiments, the swelled screen assembly can provide an amount of collapse support within a range of 500 psi to 2000 psi.

Figure 3:
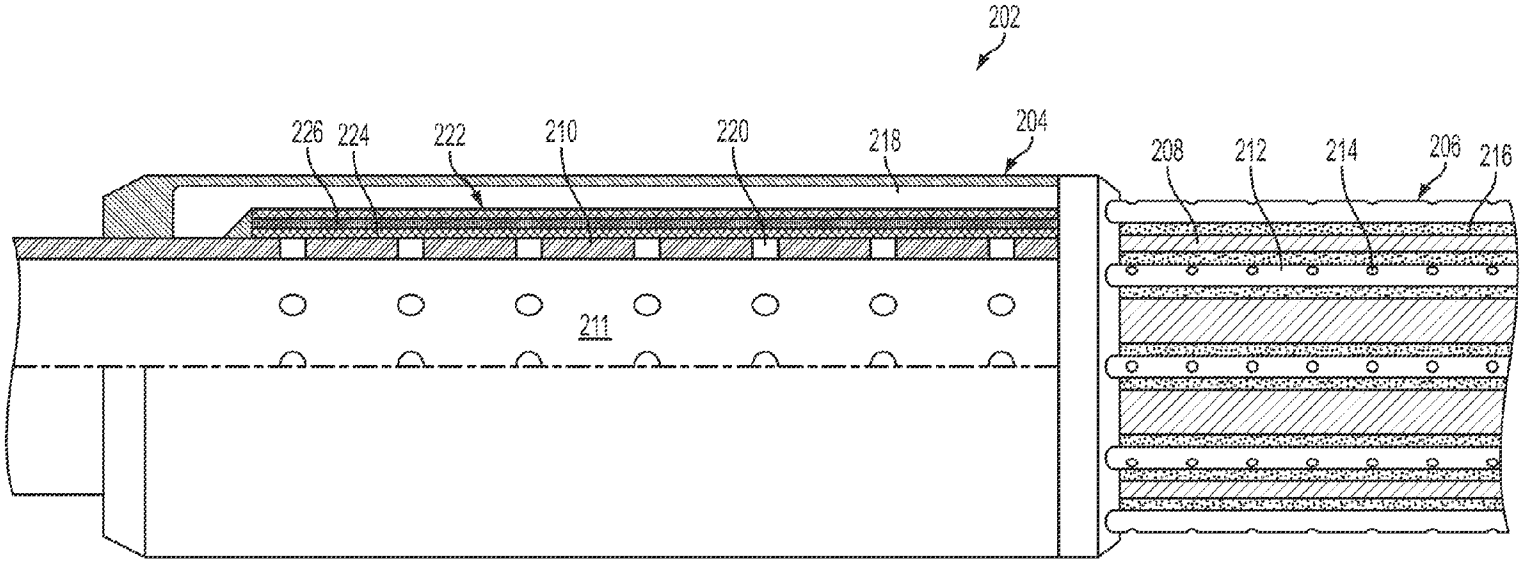
FIG. 3 is a side view of a screen assembly according to one embodiment of the present invention.

Screen assemblies according to some embodiments of the present invention can include other components in addition to tubes for collecting hydrocarbon fluid. FIG. 3 shows one embodiment of a screen assembly 202 in a running configuration that includes an outer housing 204 and a fluid collection subassembly 206. The fluid collection subassembly 206 includes swellable material 208 disposed exterior to part of a base pipe 210. The base pipe 210 defines an internal flow path 211 for hydrocarbon fluid flow. Tubes 212 are disposed exterior to the swellable material 208. The swellable material 208 can expand after contacting an activating fluid to displace the tubes 212 toward a formation. Each of the tubes 212 includes perforations 214 that are capable of receiving hydrocarbon fluids from the formation and directing the hydrocarbon fluids to the outer housing 204 in an operating configuration. For each of the tubes 212, support material 216 is located between the tube and the swellable material 208. The support material 216 can be a low swelling or non-swelling material that can reduce or prevent plugging of the perforations 214 by the swellable material 208, such as by isolating the perforations 214 from the swellable material 208.

The outer housing 204 is disposed exterior to a second portion of the base pipe 210. The outer housing 204 is also located in series with the fluid collection subassembly 206 such that fluid passes through the fluid collection subassembly 206 before entering the outer housing 204. The outer housing 204 defines an annular chamber 218 exterior to the second portion of the base pipe 210. The second portion of the base pipe 210 includes openings 220 in a sidewall of the base pipe 210 through which fluid can flow from the annular chamber 218 to internal flow path 211. Filter mediums 222 are disposed exterior to the openings 220 and can filter particulate materials from hydrocarbon fluids before the hydrocarbon fluids flow through openings 220 to the internal flow path 211.

Each of the filter mediums 222 can include a filter housing 224 in which a filter material 226 is disposed. Part or the entire filter housing 224 may be perforated to allow hydrocarbon fluids to flow in and out of the filter mediums 222. The filter material 226 may be a wire mesh material that can filter particulate materials from hydrocarbon fluids.

In an operating configuration, the swellable material 208 expands after contacting an activating fluid, such as hydrocarbon fluids, a gas, or water. Expansion of the swellable material 208 displaces tubes 212 to a formation. At least part of the tubes 212 and part of the swellable material 208 may contact an inner diameter of the formation to provide support to the formation. The hydrocarbon fluids produced by the formation can flow through perforations 214 into one or more tubes 212. The tubes 212 can direct the hydrocarbon fluids to the annular chamber 218 of outer housing 204. The support material 216 can prevent or reduce plugging of the perforations 214 by the swellable material 208 expanding or otherwise. For example, the support material 216 may be a material that does not expand or expands less than the swellable material 208 after contacting an activating fluid and isolates the perforations 214 from the swellable material 208.

The hydrocarbon fluids in the annular chamber 218 can flow through the filter mediums 222 to openings 220 of base pipe 210. The filter mediums 222 can filter particulate materials from the hydrocarbon fluids. The filter hydrocarbon fluids can flow through openings 220 to the internal flow path 211 of the base pipe 210. The hydrocarbon fluids can flow to a surface through internal flow path 211.

The outer housing 204 depicted in FIG. 3 includes filter mediums 222. In other embodiments of the present invention the outer housing 204 can include different or additional components that are configured to filter hydrocarbon fluids, control hydrocarbon fluid flow, or otherwise assist in hydrocarbon production. Examples of these components include inflow control devices and fluid discriminators. Inflow control devices can controllably allow and prevent fluid flow. Fluid discriminators can be configured to select a type of fluid, such as hydrocarbon fluid, for which to allow flow and prevent other types of fluid, such as gas and water, from flowing.

Figure 4A:
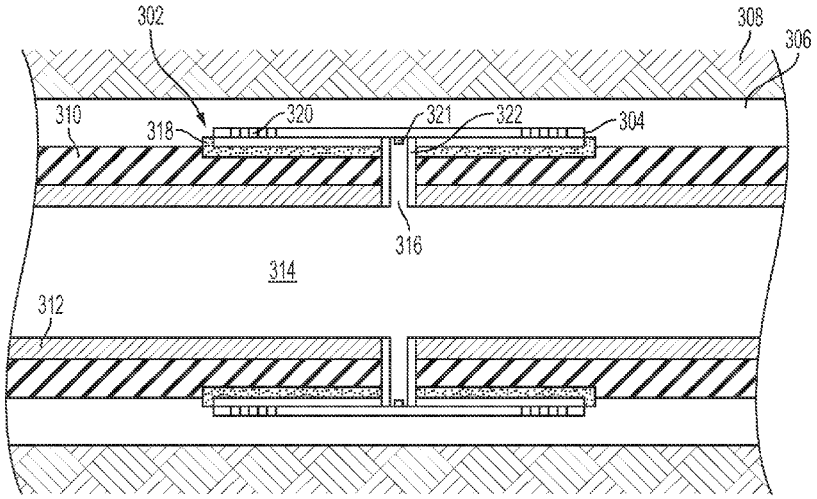
FIG. 4A is a cross sectional view of a screen assembly in a running configuration according to one embodiment of the present invention.
Figure 4B:
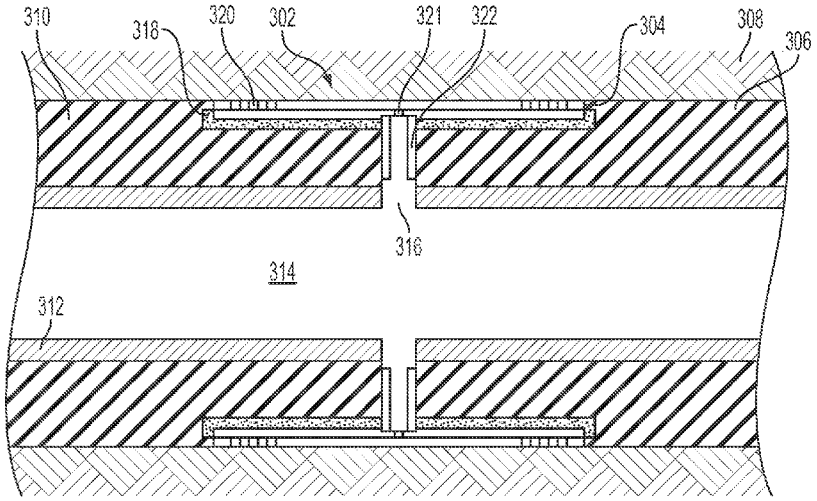
FIG. 4B is a cross sectional view of a screen assembly in an operating configuration according to one embodiment of the present invention.

Screen assemblies according to some embodiments of the present invention include tubes that are filter mediums capable of filtering hydrocarbon fluids produced by a formation and capable of directing filtered hydrocarbon fluids to an internal flow path of a base pipe. FIGS. 4A-4B illustrate a cross-sectional view of screen assembly 302 with tubes 304 that are filter mediums in a running configuration (FIG. 4A) and an operating configuration (FIG. 4B).

The screen assembly 302 is disposed in a bore 306 in a hydrocarbon fluid-producing formation 308. The screen assembly 302 includes a swellable material 310 disposed exterior to a base pipe 312. The base pipe 312 defines an internal flow path 314 and the base pipe 312 includes openings 316 in a sidewall portion of the base pipe 312. The openings 316 provide a fluid flow path to the internal flow path 314 of the base pipe 312.

The tubes 304 are disposed exterior to at least part of the swellable material 310. Support material 318 is located between each of the tubes 304 and the swellable material 310. In some embodiments, each of the tubes 304 and its corresponding support material 318 are located in a groove of the swellable material 310. Each of the tubes 304 can include perforations 320, a filter material, and an opening 321. Hydrocarbon fluids from the formation 308 can enter the tubes 304 through the perforations 320 and the filter material can filter particulate materials from the hydrocarbon fluids.

Pistons 322 can be located in openings 316 and can be coupled to the tubes 304. The pistons 322 include a telescoping portion that can extend from the openings 316 of the base pipe 312 in an operating configuration.

In the operating configuration, the swellable material 310 expands after contacting an activating fluid, such as hydrocarbon fluid, gas, or water. Expansion of the swellable material 310 displaces the tubes 304 to the formation 308. At least part of the tubes 304 and part of the swellable material 310 can contact the formation 308. The tubes 304 and swellable material 310 may support the formation 308 at a production interval to prevent formation collapse, for example. The support material 318 can retain its initial shape or otherwise can expand less than the swellable material 310 and can isolate openings 321 from the swellable material 310 to reduce or prevent plugging. The telescoping portion of each of the pistons 322 can extend from the openings 316 when the tubes 304 are displaced to the formation 308. The telescoping portion can provide a fluid conduit from the tubes 304 to the internal flow path 314.

Hydrocarbon fluids can be produced by the formation 308 and received by the tubes 304 through perforations 320. The tubes 304 can filter particulate materials from the hydrocarbon fluids. The filtered hydrocarbon fluids flow through opening 321 in the tubes 304 to the conduit formed by the telescoping portion of the pistons 322. The filtered hydrocarbon fluids can flow from the conduit to the internal flow path 314 through the opening 316. The filtered hydrocarbon fluids can be produced at the surface through the internal flow path 314.

Figure 5:
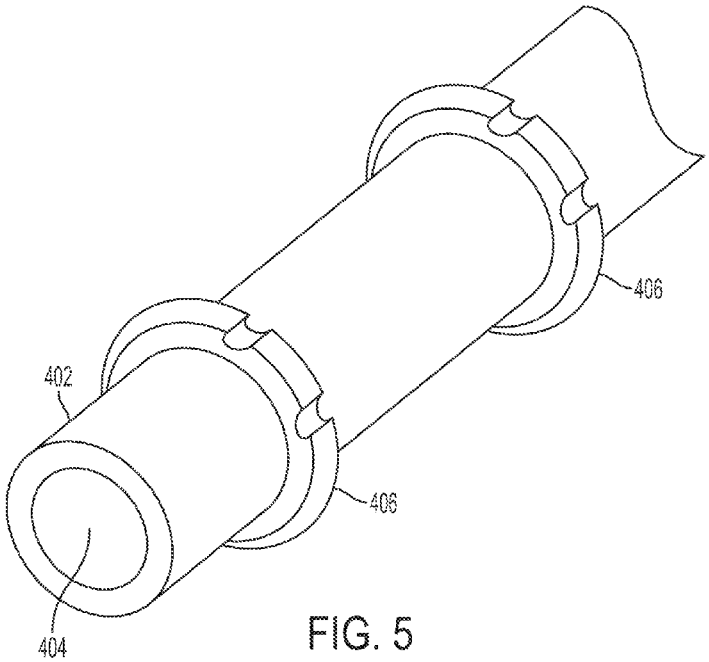
FIG. 5 is a perspective view of a base pipe and framing members according to one embodiment of the present invention.

Screen assemblies according to various embodiments of the present invention can be manufactured by a variety of processes. FIGS. 5-10 illustrate a manufacturing process of a screen assembly according to one embodiment of the present invention. FIG. 5 illustrates a perspective view of a base pipe 402 that defines an internal flow path 404. Framing members 406 are located exterior to the base pipe 402. FIG. 5 shows two framing members 406 that are spaced a selected distance from each other. The distance between the two framing members 406 can be selected based on a production interval length or on a desired length of swellable material. Furthermore, manufacturing processes according to some embodiments can utilize one framing member. The framing members 406 may be detachably coupled to the base pipe 402. In other embodiments, the framing members 406 are permanently coupled to the base pipe 402 or a base pipe that includes framing members integrally formed with the base pipe is provided. The framing members 406 may be a rigid material such as metal or composite polymer.

Figure 6:
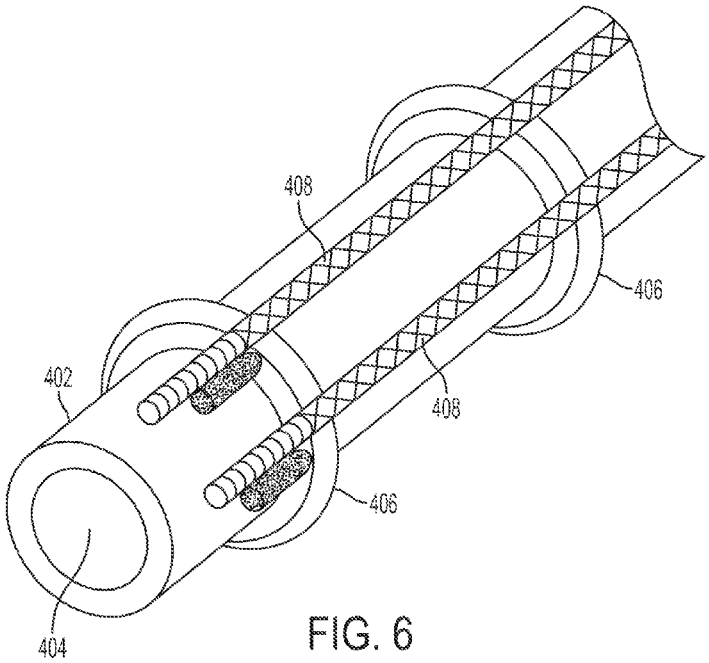
FIG. 6 is a perspective view of the casting members coupled to the framing members of FIG. 5 according to one embodiment of the present invention.

In FIG. 6, casting members 408 are positioned exterior to the base pipe 402. For example, the casting members 408 can be positioned in grooves of the framing members 406. The casting members 408 can be detachably coupled to the framing members 406 by the grooves, clamps, or similar devices. In some embodiments, a temporary bonding material couples the casting members 408 to the framing members 406. The casting members 408 may be a rigid material such as metal or composite polymer.

Figure 7:
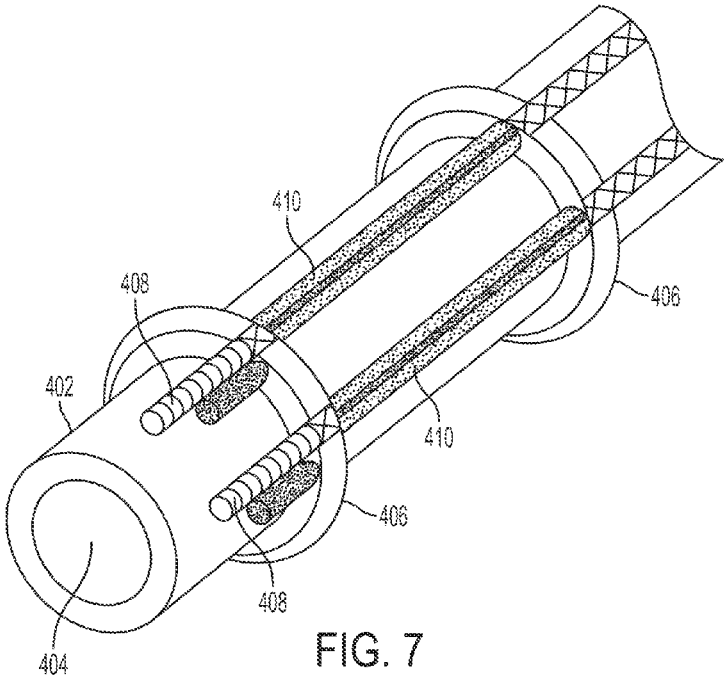
FIG. 7 is a perspective view of support material positioned between the base pipe and the casting members of FIG. 6 according to one embodiment of the present invention.

In FIG. 7, support material 410 is positioned between each of the casting members 408 and the base pipe 402. The support material 410 can be positioned between each of the casting members 408 by locating the support material 410 on an exterior of at least part of the casting members 408. The support material 410 may be a low swelling or a non-swelling material that can retain its initial shape or otherwise expand less than swellable material after contacting an activating fluid. An example of support material 410 includes HNBR. In some embodiments, the support material 410 is coupled temporarily to the casting members 408 by a temporary bonding agent such as an epoxy.

Figure 8:
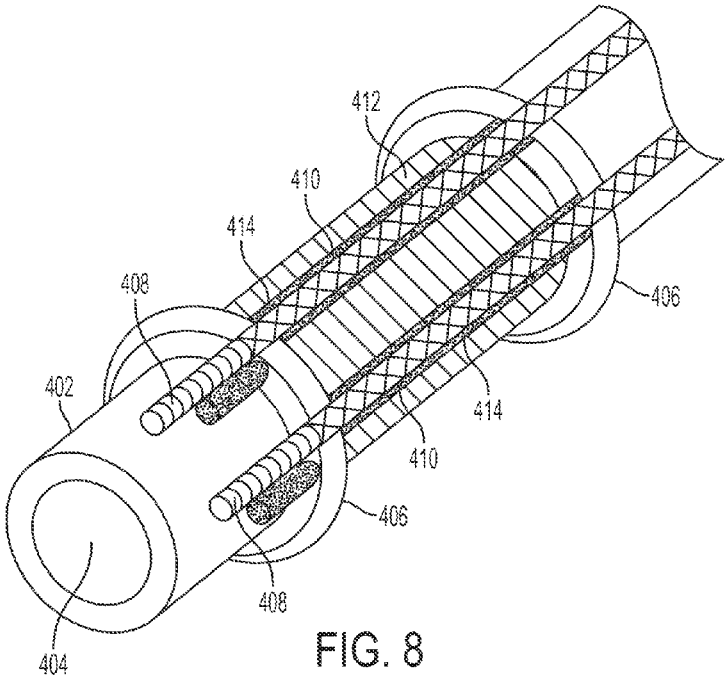
FIG. 8 is a perspective view of swellable material positioned on the base pipe of FIG. 7 according to one embodiment of the present invention.

In FIG. 8, a swellable material 412 is positioned exterior to the base pipe 402 and between the support material 410 and the base pipe 402. The swellable material 412 may be a material that can expand in response to an activating fluid, such as a hydrocarbon fluid, a gas, or water. The swellable material 412 can be processed using heat and pressure to form grooves 414 in which the casting members 408 and support material 410 are disposed.

Figure 9:
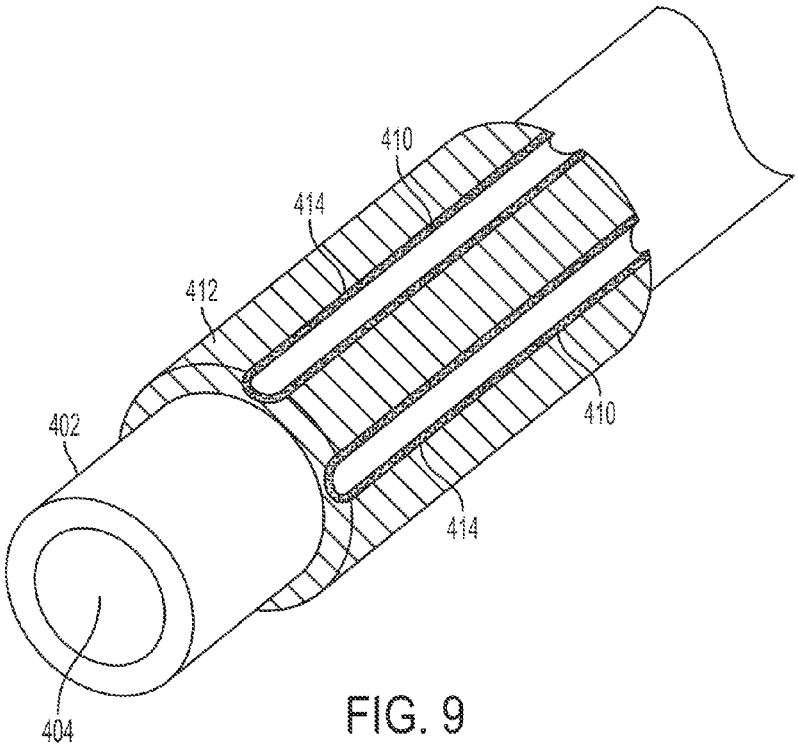
FIG. 9 is a perspective view of a groove in the swellable material of FIG. 8 after removing the casting members and framing members according to one embodiment of the present invention.

In FIG. 9, the framing members 406 and casting members 408 are removed. For example, the casting members 408 can be removed from grooves 414 and detached from the framing members 406. The framing members 406 can be detached from the base pipe 402. In some embodiments, the framing members 406 remain coupled to the base pipe 402 or are integrally formed with the base pipe 402, which prevents removal. Removing the casting members 408 can leave support material 410 disposed in each of the grooves 414 defined by the swellable material 412.

Figure 10:
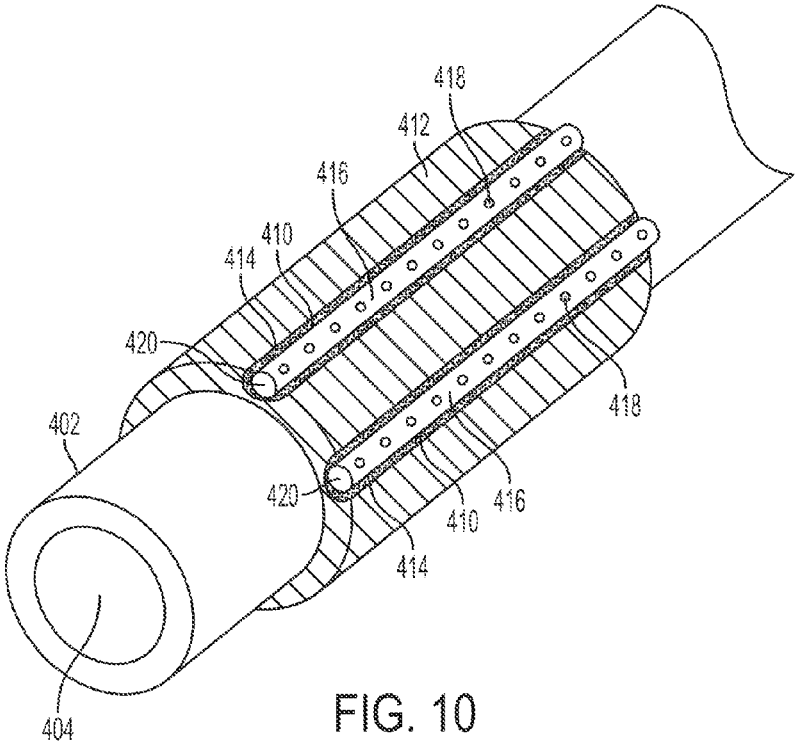
FIG. 10 is a perspective view of tubes positioned in the grooves of FIG. 9 according to one embodiment of the present invention.

In FIG. 10, tubes 416 are positioned in the grooves 414. Each of the tubes 416 can include perforations 418 for receiving hydrocarbon fluid from a formation and can define a collection flow path 420 for directing the hydrocarbon fluid to another component, such as an inflow control device, filtration media, or discrimination component, associated with the base pipe 402. The support material 410 is configured to isolate the perforations 418 from the swellable material 412 when the swellable material 412 expands after contacting an activating fluid.

The base pipe 402, with the swellable material 412, support material 410, and tubes 416, can be further processed to form a completed screen assembly. For example, additional components, such as inflow control devices, filtration mediums, and discrimination components, can be coupled to the base pipe 402 and the tubes 416 to form a screen assembly capable of being disposed in a bore in a formation. In some embodiments, the tubes 416 are filtration tubes that can filter particulate material from hydrocarbons produced by the formation, otherwise the tubes 416 are configured to not require additional components to complete the screen assembly.

Illustrative Swellable Material Compositions

Swellable material according to certain embodiments can be formed from one or more materials that swell upon contact with an activating fluid. For example, the swellable material may be a polymer that is capable of swelling to a size that is multiple times its initial size upon contact with an activating fluid that stimulates the material to expand. In some embodiments, the swellable material swells upon contact with an activating fluid that is a hydrocarbon fluid or a gas. The hydrocarbon fluid is absorbed by the swellable material and the absorption causes the volume of the swellable material to increase, thereby expanding radially. The swellable material may displace the tubes and part of the outer surface of the swellable material contacts a formation face in an open hole completion or a casing wall in a cased wellbore.

Some embodiments of the swellable material may be made from an elastic polymer. Examples of elastic polymers include ethylene propylene diene monomer (EPDM) rubber, styrene butadiene, natural rubber, ethylene propylene monomer rubber, ethylene vinyl acetate rubber, hydrogenized acrylonitrile butadiene rubber, acylonitrile butadiene rubber, isoprene rubber, chloroprene rubber and polynorbornene. The swellable material may also include other materials dissolved in, or in mechanical mixture, with the other materials that form the swellable material. Examples of other materials include fibers of cellulose, polyvinyl chloride, methyl methacrylate, acrylonitrile, ethylacetate, or other polymers.

In some embodiments, the swellable material is configured to expand upon contact with an activating fluid that is water. For example, the swellable material may be a water-swellable polymer such as a water-swellable elastomer or water-swellable rubber. More specifically, the swellable material may be a water-swellable hydrophobic polymer or water-swellable hydrophobic copolymer such as a water-swellable hydrophobic porous copolymer. Other polymers that can be used to form the swellable material include hydrophilic monomers and hydrophobically modified hydrophilic monomers. Examples of suitable hydrophilic monomers include acrylamide, 2-acrylamido-2methyl propane sulfonic acid, N,N-dimethylacrylamide, vinyl pyrrolidone, dimethylaminoethy1 methacrylate, acrylic acid, trimethylammoniumethyl, methacrylate chloride, dimethylaminopropylmethacrylamide, methacrylamide, and hydroxyethyl acylate.

A variety of hydrophobically modified hydrophilic monomers can be utilized in accordance with certain embodiments. Examples of hydophobically modified hydrophilic monomers include alkyl acrylates, alkyl methacrylates, alkyl acrylamides, alkyl methacrylamides (where alkyl radicals have from about 4 to about 22 carbon atoms), alkyl dimethylammoniumethyl methacrylate chloride and alkyl dimethylammoniumethyl methacrylate iodide (where the alkyl radicals have from about 4 to about 22 carbon atoms), alkyl dimethylammonium-propylmethacrylamide bromide, alkyl dimethylammonium propylmethacrylamide chloride and alkyl dimethylammonium-propylmethacrylamide iodide (where the alkyl groups have from about 4 to about 22 carbon atoms).

Polymers suitable in swellable material according to certain embodiments can be prepared by polymerizing any one or more of the hydrophilic monomers with any one or more of the hydrophobically modified hydrophilic monomers. The polymerization reaction can be formed in various ways, an example of which is described in U.S. Pat. No. 6,476,169, which is incorporated herein by reference. These polymers may have estimated molecular weights in the range from about 100,000 to about 10,000,000, with a preferred range of 250,000 to about 3,000,000. These polymers may also have mole ratios of the hydrophilic monomer(s) to the hydrophobically modified hydrophilic monomer(s) in the range of from about 99.98:0.02 to about 90:10.

In some embodiments, the swellable material may be made from a salt polymer such as polyacrylamide or modified crosslinked poly(meth)acrylate that tends to attract water from salt water through osmosis. For example, when water that flows from an area of low salt concentration (the formation water) to an area of high salt concentration (a salt polymer), across a semi-permeable membrane (an interface between the salt polymer and production fluids), the salt polymer allows water molecules to pass, but prevents passage of dissolved salts.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A method of manufacturing a screen assembly capable of being disposed in a bore, the method comprising:

positioning a casting member exterior to a base pipe;

positioning a support material between the casting member and the base pipe;

positioning a swellable material between the support material and the base pipe, the swellable material being configured to expand in response to an activating fluid and expand more than the support material;

processing the swellable material to form a groove in which the casting member and the support material are disposed;

removing the casting member from the groove;

positioning a tube having a plurality of perforations in the groove, the tube being adapted to direct fluid to an outer housing prior to directing the fluid to an inner diameter of the base pipe; and thereby providing a screen assembly having the support material situated intermediate the swellable material and the tube for preventing the swellable material from plugging the plurality of perforations in the tube upon expansion of the swellable material.

2. The method of manufacturing of claim 1, wherein the tube comprises a plurality of perforations, wherein the support material is capable of isolating the plurality of perforations from the swellable material when the swellable material expands.

3. The method of manufacturing of claim 1, wherein the support material is a low-swelling rubber compound configured to expand less than the swellable material.

4. The method of manufacturing of claim 1, wherein the support material is a non-swelling rubber compound configured to retain an initial shape when the swellable material expands.

5. The method of manufacturing of claim 1, wherein the support material is hydrogenated nitrile butadiene rubber (HNBR).

6. The method of manufacturing of claim 1, wherein the tube is a filtration tube comprising a filter media capable of filtering particulate materials from hydrocarbon fluid.

7. The method of manufacturing of claim 1, further comprising:

positioning a framing member exterior to the base pipe, wherein positioning the casting member exterior to the base pipe comprises coupling the casting member to the framing member.

* * * * *